United States Patent [19]

Hull

[11] Patent Number: 5,042,591

[45] Date of Patent: Aug. 27, 1991

[54] "T" POST PULLER-POUNDER

[76] Inventor: Robert N. Hull, 10189 Gregory Rd., Valley Springs, Calif. 95252

[21] Appl. No.: 408,911

[22] Filed: Sep. 18, 1989

[51] Int. Cl.[5] ..... B25D 9/00

[52] U.S. Cl. ..... 173/91; 173/90; 173/132

[58] Field of Search ..... 173/90, 91, 128, 132; 405/232

[56] References Cited

U.S. PATENT DOCUMENTS

| | | | |
|---|---|---|---|
| 716,274 | 12/1902 | Peirce, Jr. | 173/91 |
| 2,629,985 | 3/1953 | McDowell | 173/91 |
| 3,712,389 | 1/1973 | Smoak | 173/90 X |
| 4,327,787 | 5/1982 | Loratto | 173/91 X |

*Primary Examiner*—Timothy V. Eley
*Assistant Examiner*—Willmon Fridie, Jr.
*Attorney, Agent, or Firm*—D. L. Tschida

[57] ABSTRACT

Slide hammer apparatus including means for restraining and non-rotatively driving and pulling fence posts. A handled, hammer section mounts in concentric, sliding relation to a main body which surrounds a fence post and contains upper and lower stops. At least one stop includes an adjustable clamp means and anvil acting pin for securing a post to the main body and permitting reciprocal motion.

6 Claims, 2 Drawing Sheets

"T" POST PULLER-POUNDER

BACKGROUND OF THE INVENTION

The present invention relates to fence post driving and extraction apparatus and, in particular, to a slide hammer type assembly including post grasping means.

Individuals concerned with stringing wire fencing must necessarily set the posts into the ground, before stringing and stretching the fencing material between the posts.

Depending upon the type of fencing material, a variety of posts may be used to support the fencing. Such posts may comprise wooden structures or formed metal structures and of which a post exhibiting a T-cross sectional shape has become particularly popular.

A problem encountered in driving such T-posts, however, is that the posts exhibit a tendency of rotating during the initial post driving strokes which can cause misalignment of the post relative to the intended fence line, thus necessitating removal and re-setting. A further problem is that once driven, these and other posts are removable only through brute force by extracting the posts either with special or heavy equipment, a jacking assembly or manually, by grasping the post and exerting an upward pulling force. Any device which minimizes the labor necessary to perform this task therefore clearly presents desirable advantages to the user.

SUMMARY OF THE INVENTION

It is accordingly a primary object of the present invention to provide an assembly which is useful to not only set or drive a fence post, but also for extracting previously driven posts.

It is a further object of the invention to provide an assembly which adjustably clamps to posts of different sizes to prevent post rotation and facilitate the driving-/extraction thereof.

It is a further object of the invention to provide an assembly including a slide hammer action.

It is a further object of the invention to provide a slide hammer section which can be manipulated between intermediate of first and second stop members.

Various of the foregoing objects and advantages of the invention are achieved in one preferred construction wherein an elongated tubular body section mounts about a selected post. A hammer section concentrically mounted about the body section includes a pair of handles and permits a slide movement between upper and lower stop members rigidly secured to the body.

The upper stop member and body section are formed to include a pin receiving slideway whereby the pin may be extended or retracted along the slideway to grasp posts secured within the primary body. A set screw means secures the pin at a desired position relative to a plurality of depressions in the pin and a contained post.

Still other objects, advantages and distinctions of the invention will become more apparent from the following description with respect to the appended drawings. It is to be appreciated, however, that the following description is not intended to be all inclusive and is made by way only of one presently preferred construction and various considered modifications and improvements thereto. The invention accordingly should not be strictly limited to the subject disclosure but should be interpreted within the spirit and scope of the following presented claims.

DESCRIPTION OF THE PREFERRED EMBODIMENT

Figure 1:
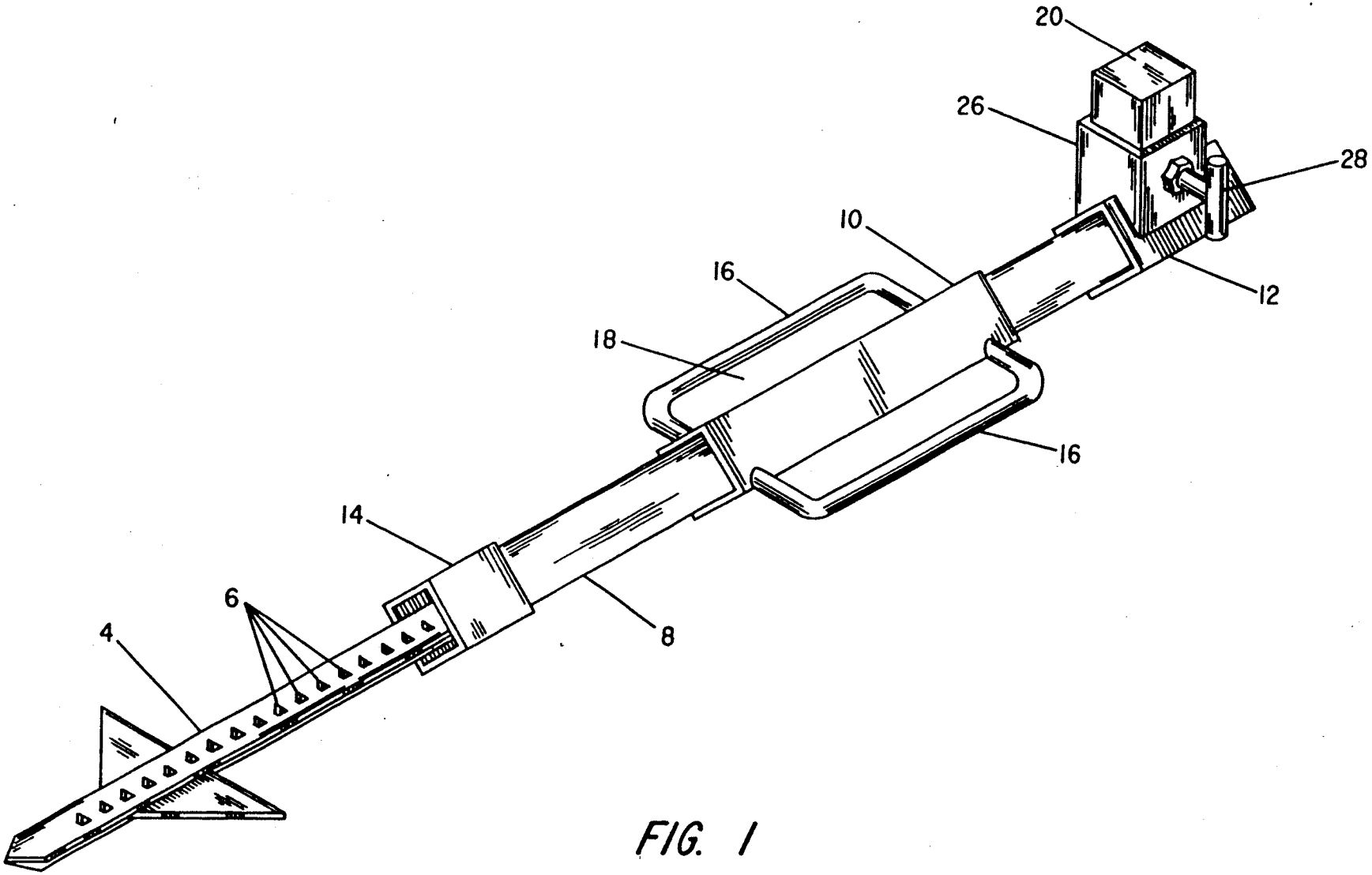
FIG. 1 shows an isometric drawing of the invention in normal mounted relation to a T post.

Referring to FIG. 1, an isometric drawing is shown of the post driving and extractor assembly 2 of the present invention as it typically mounts to a fence post 4. The assembly 2 finds particular advantage with respect to driving and extracting fence posts 4 which exhibit T-cross sectional configurations. Such posts along a front webbing face typically provide for a plurality of spaced apart, downwardly projecting loops or lugs 6 which are suitable for grasping or restraining various single or multiple stranded wire fencing (not shown). Apertures (not shown) may also be let into the webbing at the locations where the loop members 6 are formed.

The post driver and extractor assembly 2 is comprised of a tubular body section 8 which in a presently preferred construction is formed of a length of rectangular tube stock approximately 40 inches in length and provides an internal free cross sectional area of $2\times1\frac{5}{8}$ inches.

Concentrically mounted about the body section 8 is a tubular hammer section 10 of lesser length which is slideably actuable between upper and lower stop members 12 and 14 which are rigidly secured to the outer periphery of the body 8 by way of welding or other rigid fastening means. In the preferred construction, the slide hammer section 10 is formed of tube stock approximately 22 inches in length and exhibits a cross sectional free area of $2\frac{1}{2}\times2$ inches. The bottom stop 14 is otherwise formed of a length of tubing $1\frac{1}{2}$ inches long and has a cross sectional free area of $2\frac{1}{2}\times2$ inches. The top stop 28 is formed of a length of tubing 3 inches long and exhibits a free cross sectional area of $2\times1\frac{3}{8}$ inches.

Rigidly secured in longitudinal, co extensive relation to the slide section 10 along opposite diagonal edge surfaces are a pair of handles 16. Typically, the handles are formed of suitable lengths of rod stock having the end portions bent to provide a hand space 18 relative to the slide section 10 to facilitate grasping by the operator.

Figure 2:
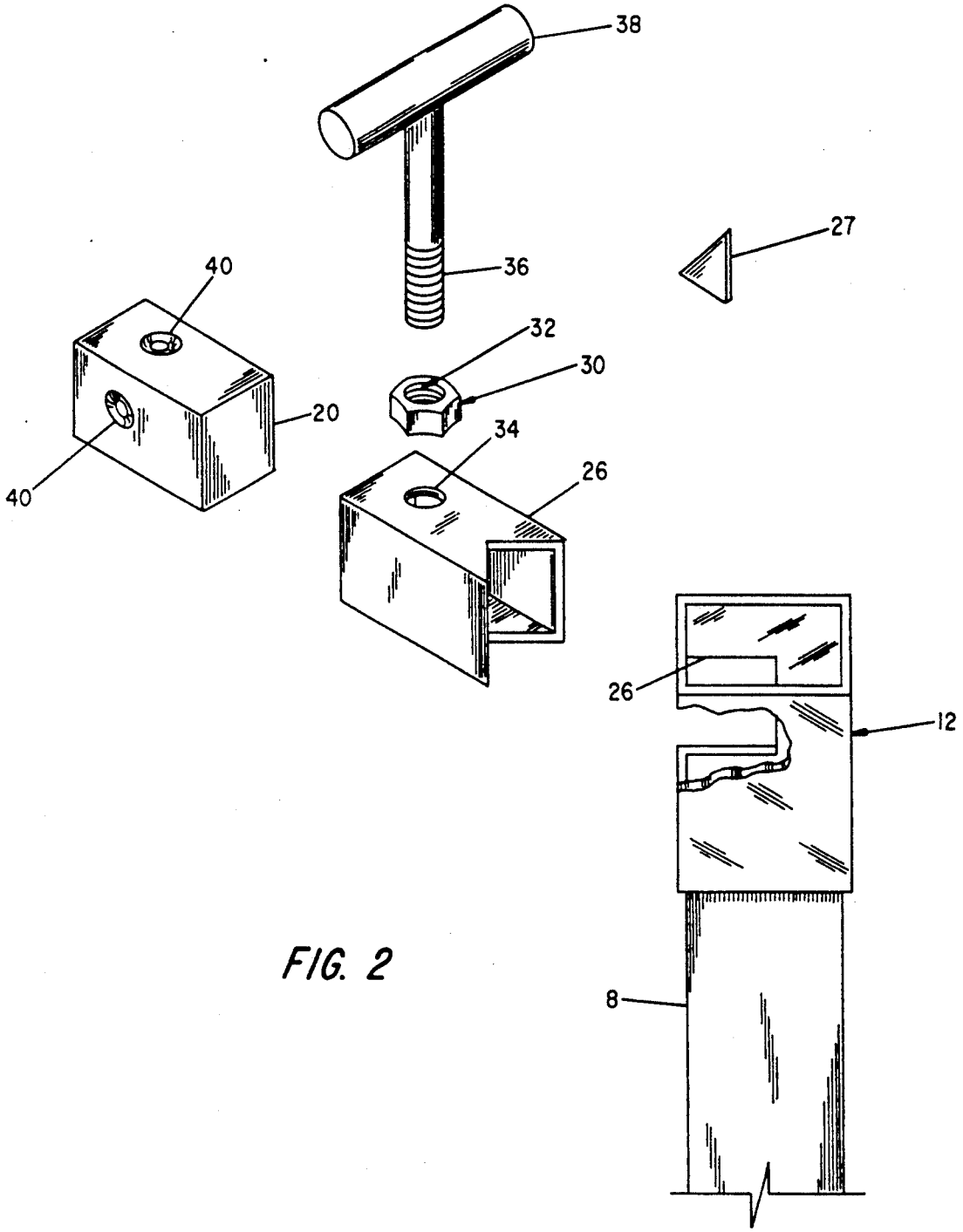
FIG. 2 shows an exploded assembly drawing of the post grasping stop member.

With attention also directed to FIG. 2, an exploded isometric view is shown of the upper stop assembly 12. The stop assembly 12 produces particular advantage for the present driver/extractor 2 in that it enables the clamping of a selected fence post relative to the driver 2. That is, the stop assembly 12 may be variously positioned along the length of a post 4 by appropriately positioning an included pin member 20 relative to the fence post 4 such that the fence post 4 is coupled in non rotative relation to the body section 8. Downward, driving or upward, extraction forces can in turn be imparted as desired.

In particular, the upper stop assembly 12 provides for a length of tube stock 22 approximately $4\frac{1}{4}$ inches in length which exhibits a cross sectional free area of $2\frac{1}{2}\times2$ inches. Let into one of the diagonal edges of the member 22 is a square aperture or relief 24 whereat a stub tubing section 26, which acts as a slideway, is welded in orthongonal projection relative to the portion 22. Triangular gussets 27 are provided to strengthen the attachment of the section 26 to the body section. The slide pin 20, which is formed of $5 \times 1\frac{3}{8}$ inch square steel key stock, mounts in the bore of the section 26 and permits an adjustable coupling of the driver/extractor 2 relative to the fence post 4. Upon appropriately extending or retracting the slide pin 20 to mate with a provided aperture or space between the loops or lugs 6, subsequent movement of the slide hammer section 10 relative to the restrained upper or lower stop 12 or 14 induces an appropriate insertion or extraction force to the fence post 4.

The specific exposure length of the slide pin 20 is determined via a T handled set screw 28 which is threadably received at the stub section 26. Specifically, a threaded nut 30 having a threaded bore 32 is welded to the stub section 26 at a provided aperture 34 to receive a threaded bolt portion 36 including a T handle 38. The screw 28 may be extended or retracted to induce a binding action at the slide pin 20, once coupled to a fence post. Alternatively the screw 28 may engage holes or depressions 40 provided along the face of the slide pin 20 to determine predefined pin insertion depths.

While the foregoing invention has been described with respect to its presently preferred construction, it is to be appreciated that those of skill in the art may consider various modifications to the above described invention. Accordingly, it is contemplated that the following claims should be interpreted to include all these equivalent embodiments within the spirit and scope thereof.

What is claimed is:

1. Fence post insertion and extraction apparatus comprising:

(a) a first elongated tubular member having a bore shaped to receive a fence post including first and second stop means fixedly secured to said first member;

(b) hammer means slideably coupled to said first member and operable between said first and second stop means; and (c) clamp means for securing said first member to a fence post placed in said bore and including a through aperture in communication with the bore, a pin mountable in said aperture and means for fixing the insertion depth of said pin to secure the fence post to the first member and whereby motion of the hammer means relative to a selected one of said upper and lower stop means imparts driving or extraction forces to the fence post.

2. Apparatus as set forth in claim 1 wherein said hammer means comprises a second tubular member of shorter length than said first tubular member, said second tubular member including a bore concentrically mounted about said first member and further including first and second handle members.

3. Apparatus as set forth in claim 1 wherein the pin exposure determining means set screw means mounted to a tubular slideway containing said pin and having a second bore extending in communication with the bore of said first member.

4. Fence post insertion and extraction apparatus comprising:

(a) a first elongated tubular member having a bore which mounts about a fence post and including first and second stop means fixedly secured to said first member;

(b) hammer means slideably coupled to said first member between said first and second stop means comprising a second tubular member of shorter length than said first tubular member mounted about said first member and including first and second handles; and (c) clamp means including a through aperture in communication with the bore of the first tubular member, a pin mountable in said aperture and means for fixing the insertion depth of said pin, whereby said pin can be brought into engagement with a mating portion of a fence post such that motion of the hammer means in an downward direction relative to a lower one of said first and second stop means produces a post driving action and motion of the hammer means in an upward direction relative to the other of said first and second stop means produces a post extraction motion.

5. Fence post insertion and extraction apparatus comprising:

(a) a first elongated tubular member including upper and lower stop means fixedly secured to said first member (b) hammer means slideably coupled to said first member and operable between said upper and lower stop means; and (c) clamp means comprising a body portion secured to said first member, a tubular slideway including a slide pin and set screw means for fixing the insertion depth of said pin, whereby said pin secures a fence post in alignment with said first member and whereby motion of the hammer means relative to a selected one of said upper and lower stop means imparts driving or extraction forces to the fence post.

6. Apparatus as set forth in claim 5 wherein said first member comprises a tubular member having a bore extending the length thereof which permits concentric mounting about the fence post.

* * * * *